US008328988B2

(12) United States Patent
Champion et al.

(10) Patent No.: US 8,328,988 B2
(45) Date of Patent: Dec. 11, 2012

(54) REDUCTION OF THE ADSORPTION OF QUATERNARY AMMONIUM SALTS ONTO CELLULOSIC FIBERS

(75) Inventors: Richard D. Champion, Federal Way, WA (US); James H. Wiley, Tacoma, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 231 days.

(21) Appl. No.: 12/724,208

(22) Filed: Mar. 15, 2010

(65) Prior Publication Data

US 2011/0220311 A1 Sep. 15, 2011

(51) Int. Cl.
*D21H 17/66* (2006.01)

(52) U.S. Cl. ..... 162/164.6; 162/141; 162/158; 162/181.2; 162/181.8; 162/185

(58) Field of Classification Search ..... 162/70, 162/79, 87, 90, 141, 158, 164.1, 164.6, 168.1, 162/168.2, 181.2, 181.3, 181.8, 184, 185
See application file for complete search history.

(56) References Cited

U.S. PATENT DOCUMENTS

| | | | | |
|---|---|---|---|---|
| 2,585,048 | A | 2/1952 | Shelanski | |
| 3,018,192 | A | 1/1962 | Hennemann et al. | |
| 3,554,862 | A * | 1/1971 | Hervey et al. | 162/158 |
| 4,035,146 | A | 7/1977 | Brenner et al. | |
| 4,311,479 | A | 1/1982 | Fenn et al. | |
| 5,377,428 | A * | 1/1995 | Clark | 34/446 |
| 5,573,637 | A * | 11/1996 | Ampulski et al. | 162/112 |
| 6,322,665 | B1 * | 11/2001 | Sun et al. | 162/158 |
| 6,429,261 | B1 * | 8/2002 | Lang et al. | 525/191 |
| 6,562,743 | B1 | 5/2003 | Cook et al. | |
| 6,942,726 | B2 | 9/2005 | Cook et al. | |
| 7,470,652 | B2 * | 12/2008 | Kilkenny et al. | 510/191 |
| 7,485,589 | B2 | 2/2009 | Ellis | |
| 2006/0141015 | A1 | 6/2006 | Tessier et al. | |
| 2008/0076313 | A1 | 3/2008 | Uitenbriek et al. | |
| 2008/0076695 | A1 | 3/2008 | Uitenbroek et al. | |
| 2010/0160201 | A1 * | 6/2010 | Scheuing et al. | 510/180 |

OTHER PUBLICATIONS

Towers.M and Scallan, Predicting the Ion-Exchange of Kraft Pulps Using Donnan Theory, Journal of Pulp and Paper Science: vol. 22, No. 9 Sep. 1996, United States.

Norberg, C., et al., Modelling the Distribution of "Free", Complexed and Precipitated Metal Ions in a Pulp suspension Using Donnan Equilibria, Journal of Pulp and Paper Science: vol. 27 No. 9 Sep. 2001, United States.

Rudie, Alan W. et al. Ion Exhange of H+, Na+, Mg+, Ca+, Mn+, and BA2+ on Wood Pulp, Journal of Wood Chemistry and Technology, 26: 259-272, 2006, Taylor & Francis Group, LLC, ISSN 0277-3813.

Bottero, J., et al., Aluminum chemistry in aqueous solution, Nordic Pulp and Paper Research Jornal No. 2/1989.

Kato, M., et al., Studies on interations between aluminum compounds and cellulosic fibers in water by means of Al-NMR, J Wood Science (2000) 46:310:316.

Athley, K., et al., Interaction between divalent metal ions and oxygen-delignified kraft pulps, Nordic Pulp and Paper Research Jornal vol. 16 No. 3/2001.

Sundman, O., et al., Acid/base and metal adsorption properties of CMC-type softwood Kraft pulps of different charge, Umea, Sweden Dept of Chemistry, Aquatic Chemistry, S-901 87 Amea, Sweden, Apr. 2006.

* cited by examiner

*Primary Examiner* — Mark Halpern
*Assistant Examiner* — Dennis Cordray
(74) *Attorney, Agent, or Firm* — Weyerhaeuser Law Dept

(57) ABSTRACT

A product comprising cellulosic fibers, 0.0001 to 0.03 moles of a water soluble metal salt per 100 grams of cellulosic fiber, based on the oven dry weight of the cellulosic fiber, water and a quantity quaternary ammonium salt to provide 100 to 3000 ppm of quaternary ammonium salt in solution. A process for making the product.

16 Claims, 5 Drawing Sheets

BAC n = 8, 10, 12, 14, 16, 18

DDAC n = 8, 10, 12, 16, 18

REDUCTION OF THE ADSORPTION OF QUATERNARY AMMONIUM SALTS ONTO CELLULOSIC FIBERS

The field of the invention is quaternary ammonium salts used with cellulosic fibers. An embodiment is an antimicrobial wipe.

Disposable antimicrobial wipes are an article of commerce that is made by saturating a non-woven substrate with a solution containing one or more quaternary ammonium salts. The non-woven substrate contains cellulosic fibers and possibly one or more synthetic fibers, such as polypropylene fibers, in a blend. Cellulosic fibers contain both cellulose and hemicellulose. Wood pulp fibers are one example of cellulosic fibers.

In the United States, the compounds and the amounts of active ingredient present in an antimicrobial wipe solution is specified in EPA docket numbers: EPA-HQ-OPP-2006-0339 and EPA-HQ-OPP-2006-0338 and 21 Code of Federal Regulations §178.1010(b) and (c). The FDA regulation applies to "food-processing equipment and utensils, and on other food-contact articles as specified", whereas the EPA regulations covers most of the other uses, primarily sanitation wipes for use with hard surfaces. §178.1010(b) specifies the compounds which can be used and §178.1010(c) specifies the amounts of the active ingredients in the solution in "at least" amounts and "not to exceed" amounts, whereas the EPA regulations specify the maximum quaternary ammonium salt concentrations.

Broadly, the quaternary ammonium salts listed are (1) n-alkyl benzyl dimethyl ammonium chlorides; (2) di-n-alkyl dimethyl ammonium chlorides; and (3) n-alkyl dimethyl ethylbenzyl ammonium chlorides.

Another name for n-alkyl benzyl dimethyl ammonium chloride is benzyl-alkyl-dimethyl ammonium chloride. It is also known as BAC or ABDAC. BAC alkyl chains may be of any length. BAC alkyl chains may range, typically, from 8 to 18 carbons in length. Other typical BAC alkyl chain lengths are 12 to 16 carbons in length and 8 and 10 carbons in length. Alkyl dimethyl ethylbenzyl ammonium chlorides, also known as ADEBAC, are grouped with BAC in the aforementioned EPA regulations, but are kept separate in the FDA code. ADEBAC have alkyl chains of any length, but principally of 12 or 14 carbons. The present invention applies to all BAC, including ADEBAC, compounds of any chain length.

Di-n-alkyl dimethyl ammonium chloride compounds are also known as dialkyl-dimethyl ammonium chloride compounds. They are also called DDAC. DDAC alkyl chains may be of any length. DDAC molecules may have, for example, alkyl chains in the range of 8 to 16 carbons in length. DDAC typically have alkyl chains in the range of 8 to 10 carbons in length.

The structures of these quaternary ammonium salts are shown in FIGS. 1 and 2. FIG. 1 shows the structure of BAC and FIG. 2 shows the structure of DDAC.

Quaternary ammonium salts, also known as "quat salts", are used as (1) single quaternary ammonium salt molecule, (2) a single type of quaternary ammonium salt though with a range of alkyl chains present, or (3) used in combination with other types of quaternary ammonium salts. Often all of these quaternary ammonium salt preparations are used in combination with other compounds, such as ethyl alcohol or isopropyl alcohol.

The effective amounts of quaternary ammonium salts in solution are also specified in the FDA Code, while the EPA regulations specify maximum concentrations. The amount is dependent on the specific quaternary ammonium salt. Some of the amounts are at least 150 ppm, a level of 150 ppm, not less than 150 ppm, 200 parts per million (ppm), not more than 200 ppm, or not more than 400 ppm. In some instances the "at least" and "not more than" amounts are listed for the same quat salt solution. In the EPA regulations for "wiping," the maximum concentrations are 2400 ppm for DDAC and for 3000 ppm BAC, including ADEBAC.

Although BAC, ADEBAC, and DDAC are discussed in detail in this application, the chemistry, and this application, applies to all quaternary ammonium salts when used with cellulosic fibers.

In order for wipes to have effective antimicrobial action, a sufficient concentration of quaternary ammonium salts must be present in the solution squeezed from the wipes during their use. In practice, a high percentage of quaternary ammonium salts are adsorbed onto the cellulosic fibers of the substrates, which may be non-woven, and the quaternary ammonium salts are, thus, unavailable to provide antimicrobial action to the surface being disinfected. It is, therefore, necessary for the manufacturers of disinfectant wipes to compensate for this by using a more concentrated solution of quaternary ammonium salts than is theoretically necessary to provide sufficient antimicrobial action. This requirement adds considerable expense to the cost of the wipes. In some instances, the FDA Code specifies the maximum amount present in the solution so there is a need to provide a concentration in the solution that is effective, but not greater than specified by the Code.

This illustrates that a large amount of quaternary ammonium salt is required to obtain a sufficient amount of quaternary ammonium salt in solution. This raises the cost of the product because of the large amount of unusable quaternary ammonium salt which must be included in the product in order to obtain a usable amount of quaternary ammonium salt.

The inventors hypothesized that one possible reason for adsorption of the quaternary ammonium salts is the possibility of an electrostatic attraction between the cellulosic fiber and the quaternary ammonium salt. They reasoned that cellulosic fiber—including most bleached kraft softwood pulps, and other wood pulps—will contain acid groups, particularly carboxylic acid groups, which under neutral and alkaline conditions, will carry a single negative charge. These negative charges would have an inherent electrostatic attraction to positive charges or cations, including quaternary ammonium salts which are cations.

The inventors' hypothesis is these acid groups on the cellulosic fiber are electrostatically attracting the quaternary ammonium salts present in the solutions and the quaternary ammonium salts are adsorbed onto the cellulosic fiber through a process of ionic bonding. Those quaternary ammonium salts that are adsorbed onto the cellulosic fiber are, therefore, not capable of being present in solutions expressed from the wipes during use. Only those salts that remain in solution are available for use.

The inventors reasoned that there was a Donnan equilibrium between the amount of quaternary ammonium salts present in solution and the amount of quaternary ammonium salts absorbed onto the cellulosic fiber. There is never a complete 100% adsorption of quaternary ammonium salts onto cellulosic fiber. For example, three-quarters of the quaternary ammonium salt may be absorbed on the cellulosic fiber and one-quarter may remain in solution. This means that in this situation if the initial concentration of quaternary ammonium salt solution exposed to the cellulosic fiber is 1000 ppm then about 250 ppm quaternary ammonium salt will remain in solution and 750 ppm quaternary ammonium salt will be absorbed onto the cellulosic fiber.

It would be advantageous to provide a means for blocking the adsorption of the quaternary ammonium salts onto the cellulosic fibers.

Figure 1:
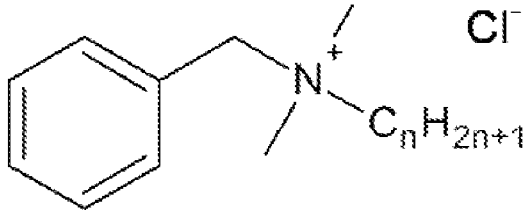
FIGS. 1 and 2 are diagrams of quaternary ammonium salts.
Figure 2:
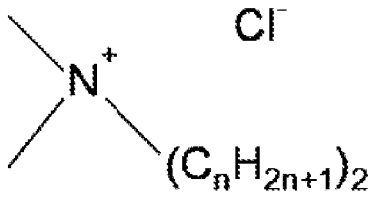

This invention describes compositions that significantly inhibit the adsorption of quaternary ammonium salts onto cellulosic fibers so that a greater percentage of the quaternary ammonium salts remain in the solution and are available for their use in sanitation. This invention will, therefore, reduce the amount of quaternary ammonium salts that must be added and, thereby, lower the overall cost of any antimicrobial wipe containing both quaternary ammonium salts and cellulosic fibers.

The present invention proposes to add a small amount of metal cations in the form of dissolved metal salts, from a single or multiple metals, to the solution to prevent adsorption of quaternary ammonium salts by the cellulosic fibers. We have found that the cellulosic fiber acid groups have a greater affinity for the metal cations than they do for the quaternary ammonium salts and, thus, metal cations are absorbed by the cellulosic fibers in place of the quaternary ammonium salts. Therefore, less quaternary ammonium salts are required to be added initially to provide an adequate amount of quaternary ammonium salts in solution, because the equilibrium for the quaternary ammonium salt is now biased toward the quaternary ammonium salt being in solution because the acid ionic sites on the cellulosic fiber are now occupied by the metal cations the quaternary ammonium salts are blocked from these sites.

It is believed that the metal cations in the composition of the invention compete with the quaternary ammonium salts for the anionic sites, typically carboxylic acid groups, which are present on the surface of the wood pulp fibers and, thereby, inhibit the quaternary ammonium ions from adsorbing onto the fibers.

This blocking of quaternary ammonium salt adsorption can be further biased by providing more metal cations than quaternary ammonium salts. This blocking of quaternary ammonium salt adsorption can also be biased by providing more metal cations than there are acid groups on the cellulosic fibers. For example, there are an estimated 3 to 5 meq (millimolar equivalents) of acid groups per 100 grams of bleached Southern Pine Kraft pulp, but other wood pulps may easily have tens of meqs of acid groups per 100 g of pulp. Unbleached pulps would have a higher number. The amount of metal salt can be in the range of 0.0001 to 0.03 moles of metal salt per 100 grams of cellulosic fibers, on an oven dry basis. In another embodiment the amount of metal salt can be in the range of 0.001 to 0.02 moles of metal salt per 100 grams of cellulosic fibers, on an oven dry basis.

The metal salt should be dissolvable in the solution. Metal cations that tend to be the most solvable are from the salts of alkali and alkali earth metals, but may also include, but not limited to, aluminum, manganese, and iron. Other metals are copper, chromium, nickel, cobalt, zinc, vanadium, tin. This could also be stated as alkali metals, alkali earth metals, first row (period 4) transition metals, tin and aluminum. Typically the most soluble metal salts are halides or sulfates. Other examples of soluble metal salts are acetates, hydroxides, phosphates, sulfites, and nitrates. This list is not inclusive.

The metal salts can be added before, during or after the addition of the quaternary ammonium salt without affecting their efficacy. The metal cations will prevent or reduce the adsorption of quaternary ammonium salt at the acid sites on the cellulosic fibers and can replace the quaternary ammonium salt if added afterwards.

The amounts of metal salts added to the compositions can be expressed in equivalents of charge. The equivalents of charge is the ratio of the moles of positive charges in the metal salt to the moles of negative charges on the pulp fibers. For example, pulp fibers having a carboxylic acid content of 4 meq/100 g has 4 millimoles of negative charges per 100 grams of pulp fibers, based on oven-dried weight. It is worth noting that carboxylic acids are monoprotic acids, meaning they have a single negative charge when deprotonated, which is the case in all neutral or alkaline solutions. If 2 millimoles metal salt having an oxidation state of 2, which produces a +2 charged metal ion when dissolved, was added to 100 grams of pulp, there would be 4 millimoles of positive charges per 100 g. In other words, 2 millimoles/100 g of a +2 metal ion is 1 equivalent to the charge on a pulp fiber having a carboxylic acid content of 4 meq/100 g. The carboxylic acid content of the wood pulps used in the following examples was measured by TAPPI Method—T237 cm-08.

The cellulosic fiber can be wood pulp fiber. Cellulosic wood pulp can be a hardwood or softwood. Cellulosic wood pulp can be treated with a debonder. Debonders are surface active chemicals that are added prior to, or during the forming and drying operation of the cellulosic wood pulp manufacturing process. The purpose of debonders is to reduce the amount of fiber-fiber bonding that takes place during drying. Examples of debonding agents are Evonik Arosurf™ PA 777, Hercules ProSoft™ TQ 3190, Nalco DVP4V009, Eka Soft™ F509 HA, F587 and F639. Cellulosic wood pulp can be treated with other debonders as well.

Cellulosic wood pulp can be treated with one or more cationic polymers. Examples of cationic polymers are cationic starch and polydiallyldimethylammonium chloride (poly DADMAC). The cellulosic wood pulp can be treated with other cationic polymers as well. The cellulosic wood pulp can be treated with clay. The cationic polymers, debonders, and clay have a small effect on blocking the absorption of quaternary ammonium salts by cellulosic fibers, as they all have positively charged elements within them.

In one embodiment, the invention provides a composition for antimicrobial wipes that significantly increases the proportion of the quaternary ammonium compounds that are not adsorbed onto the substrate, when the solution is squeezed out of the wipes. In its simplest form, the composition of the invention contains water, cellulosic fibers, one or more quaternary ammonium salts, and a soluble metal salt, such as aluminum sulfate. The cellulosic fibers can be wood pulp fibers.

In one embodiment of the invention the composition contain a 3 to 1 or 6 to 1 weight/weight (w/w) ratio of water to cellulosic fibers which are in sheet form either by themselves or in a blend with synthetic fibers. In one embodiment of the invention the concentration of the quaternary ammonium compounds in the solution is between 100 and 1000 ppm (weight basis). The quaternary ammonium salts explored were benzylalkyldimethyl ammonium chloride (BAC), dialkyldimethyl ammonium chloride (DDAC), or a commercial quaternary ammonium salt disinfectant. The commercial product was Virex, an antimicrobial cleaner manufactured by Johnson Wax. It contains an about a 1:1 mixture of BAC and DDAC, as well as other proprietary ingredients.

In one embodiment the soluble metal salt is aluminum sulfate, $Al_2(SO_4)_3$. In one embodiment the weight to weight (w/w) range of metal salt to cellulosic fiber can be 0.0001 to 0.03. In another embodiment the w/w range of metal salt to cellulosic fiber was between 0.0023 and 0.011. Aluminum sulfate can be effective in reducing the percentage of quaternary ammonium salts that are absorbed to the substrate greater than these w/w ranges. Higher levels of aluminum sulfate would also be effective with the only restriction being to the solubility limits of the aluminum sulfate. However, high levels of aluminum salts, or in other embodiments other metal salts, may cause discoloration or other problems, including texture, in the wipes.

In one embodiment, a soluble metal salt solution is applied to the wood pulp fibers prior to the manufacture of the disposable wipes. However, it is equally effective to add the soluble metal salt directly to the solution containing the quaternary ammonium salts in a solution added to the wipe substrates at the end of the manufacturing process. It is important that a sufficient quantity of soluble aluminum, and/or other soluble metal cation(s), be present in the antimicrobial composition containing pulp fibers and quaternary ammonium salts.

In a wipe the cellulosic fiber can range from 10 to 100% of the weight of the wipe substrate, the fibrous material in the wipe. The cellulosic fiber can be a wood pulp fiber. The weight of the quaternary ammonium salt solution typically used for this invention can be from 2 to 10 times the weight of the dry substrate. The solution is water and quaternary ammonium salt. The quat salt, or mixture of quat salts, concentration in the wipe saturant can be 100 to 3000 parts per million (weight basis). The amount of metal salts or mixture of metal salts can be from 0.0001 to 0.03 moles per 100 grams of wood pulp fiber, measured on an oven-dried basis. The ratio of metal ion charge equivalents to wood pulp fiber charge equivalents is 0.1 to 45.

The addition of metal cations, from dissolved metal salts, to compositions containing quaternary ammonium salt and wood pulp fibers significantly reduces the amount of quaternary ammonium salt adsorbed onto the pulp fibers compared to compositions containing only wood pulp fibers and quaternary ammonium salts alone. A range of metal salts and metal salt concentrations have proved to be effective. The metal salts may be, for example, calcium chloride, magnesium chloride and aluminum sulfate. In one embodiment, the range of metal salt concentrations may be from 0.001 moles of metal salt per 100 grams of wood pulp fiber, based on oven-dried weight, to 0.02 moles of metal salt per 100 grams of pulp fiber, based on oven-dried weight. The effective range of metal ion could be as low as 0.0001 moles of applied metal ions per 100 grams of wood pulp fiber, based on oven-dried weight. Although the upper range of metal salt addition is only restricted by the solubility of the metal salt chosen and other considerations, such as, discoloration, softness or health issues, the reasonable upper limit could be 0.03 moles of metal salt per 100 grams of oven dry wood pulp fiber.

The metal salts can be added to the composition in several different ways without affecting their efficacy in preventing the adsorption of quaternary ammonium salts. The metal salts may be added, but are not limited to, at a point during the wet-laid sheet forming process during pulp fiber manufacturing, or after the wood pulp fibers have been dried in sheet form via spray or shower addition, or added directly to a mixture containing the wood pulp fibers and quaternary ammonium salts.

The wood pulp fibers in the mixture containing fibers, quaternary ammonium salts and metal cations can be in sheet form. Pulp sheets have basis weights of 250 to 900 g/m$^2$. The density of a wipe is 0.05 to 0.6 grams per cubic centimeter.

In the following examples the terms such as "percent BAC rejected" and "percent quaternary ammonium salt rejected" refer to the percentage of quaternary ammonium salts, either a specific variety, such as BAC, or a combined DDAC and BAC solution referred to as "quaternary ammonium salts", that are added to the compositions that are not adsorbed on the wood pulp fibers when liquid is squeezed out of the mixture containing pulp fibers, dissolved quaternary ammonium salts and dissolved metal ions. For example, if pulp fibers in sheet form are exposed to a solution containing 1000 ppm of a quaternary ammonium salt, and the concentration of the quaternary ammonium salt in the solution that has been squeezed out of the mixture is 250 ppm, then the percent quaternary ammonium salt rejection is said to be 25%. That is, 25% percent of the quaternary ammonium salt has not been adsorbed onto the fibers. Another way of expressing it is that 25% of the applied quaternary ammonium salts are in solution and, therefore, available for use as disinfectants.

EXAMPLE 1

The Effect of Various Metal Ions on Quaternary Ammonium Salt Rejection Efficiency In Example 1, various metal salts were added to CF416 wood pulp in a manner meant to mimic wet-end addition on a paper machine. CF416 is a bleached southern pine kraft wood pulp manufactured by Weyerhaeuser NR in Columbus Miss. The effectiveness of each of 3 metal salts were compared. These were magnesium chloride (magnesium chloride hexahydrate from Sigma Aldrich), calcium chloride (calcium chloride anhydrous from Sigma Aldrich), and aluminum sulfate (aluminum sulfate octadecahydrate from Sigma Aldrich). The CF416 pulp sheet was cut into small pieces and soaked in a solution of the appropriate metal salt. The ratio of salt solution to pulp fiber was 3 to 1, weight to weight. The concentration of salt in solution was adjusted so that the ratio of metal charge to pulp charge was 1 equivalent. This equated to 1904 ppm of anhydrous magnesium chloride, 2220 ppm of anhydrous magnesium chloride and 2281 ppm anhydrous aluminum sulfate. The pulp fibers were allowed to soak in the metal salt solutions between 1 and 2 hours at room temperature in plastic medical syringes (BD medical).

After the pulp samples had been soaked in the metal salt solutions, the syringes were placed in a caulking gun, and the free liquid was expressed from the samples. This same procedure was then repeated several times, but with distilled water and then the samples were dried. Four quaternary ammonium salt solutions were prepared having the following concentrations; 100 ppm, 200 ppm, 500 ppm and 1000 ppm by dissolving the appropriate weight of BAC (Sigma Aldrich MW 365 g/mole) in deionized water. The quaternary ammonium salt solutions were placed in separate plastic syringes (BD Medical) to which a known quantity of pulp sheet pieces treated with metal salts in the manner detailed above had been added. The weight to weight (w/w) ratio of the quaternary ammonium salt solution to the dry weight of the pulp was 3:1 in all cases. Thus, for example, one syringe containing calcium chloride treated pulp plus 3 times its weight of 100 ppm BAC solution, while the next syringe contained calcium chloride treated pulp plus 3 times its weight of 200 ppm BAC solution and so on until all combinations of pulp treatments and BAC solution concentrations were prepared.

The syringes containing quaternary ammonium salt solution plus pulp were allowed to stand for about 1.5 hours at room temperature. At the end of the exposure time each syringe was placed in a calking gun and pressure was applied to the syringe plunger until the free quaternary ammonium salt solution could be collected for analysis. The unadsorbed quaternary ammonium salt concentration was measured by CE as described in Example 5.

Figure 3:
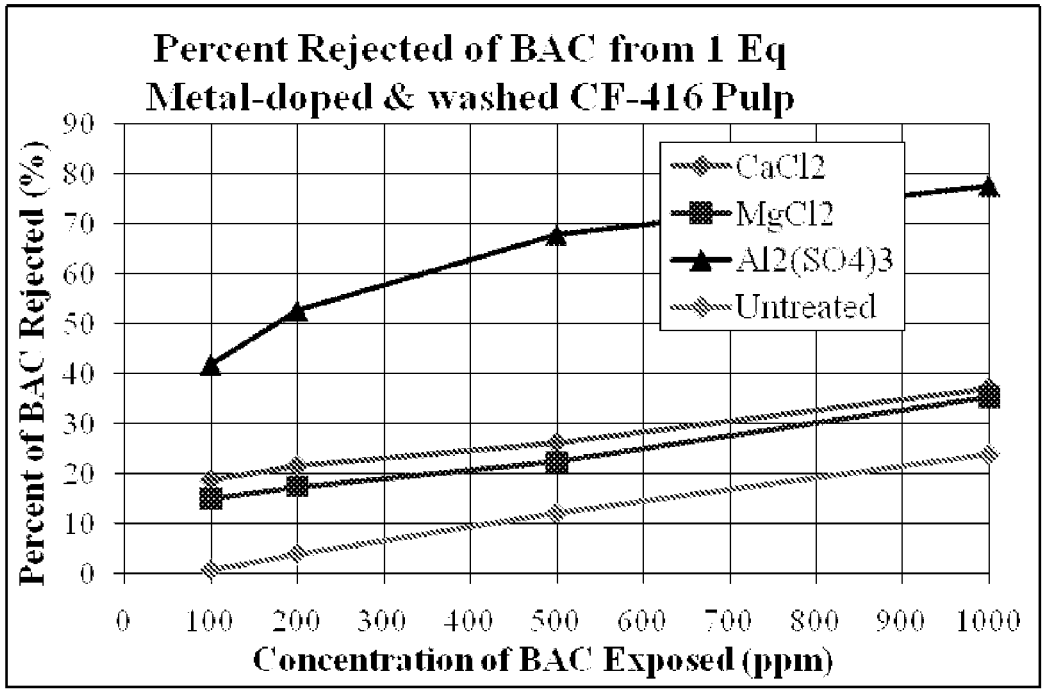
FIGS. 3-9 are graphs showing the percentage of quaternary ammonium salts rejected by cellulosic fiber under different conditions.

FIG. 3 shows that all three metal salts ($CaCl_2$, $MgCl_2$, and $Al_2(SO_4)_3$) had significant effects upon the percentage of BAC rejected. Thus, in all these cases these metal salts were effective in increasing the amount of quaternary ammonium salt in solution, with aluminum sulfate being the most effective.

EXAMPLE 2

The Effect of Salt Addition Mode on Quaternary Ammonium Salt Rejection

In Example 2, the method by which the metal is added to composition containing quaternary ammonium salt and pulp fibers was studied. The first series of samples was prepared in the manner described in Example 1. These samples were meant to simulate metal salt addition in the wet-end of the papermaking process (Al—Wet-End in FIG. 4). The second series of samples was prepared by squirting a known amount of metal salt solution onto the pulp sheet with a syringe in parallel streaks, and allowing the sample to air dry without washing. This method was meant to simulate addition of the metal salts at the dry-end pulp sheet making process or during a non-woven manufacturing process (Al—Dry-End in FIG. 4). In these series the treated pulp samples and the quaternary ammonium salt solutions were combined in the same manner described in Example 1.

Figure 4:
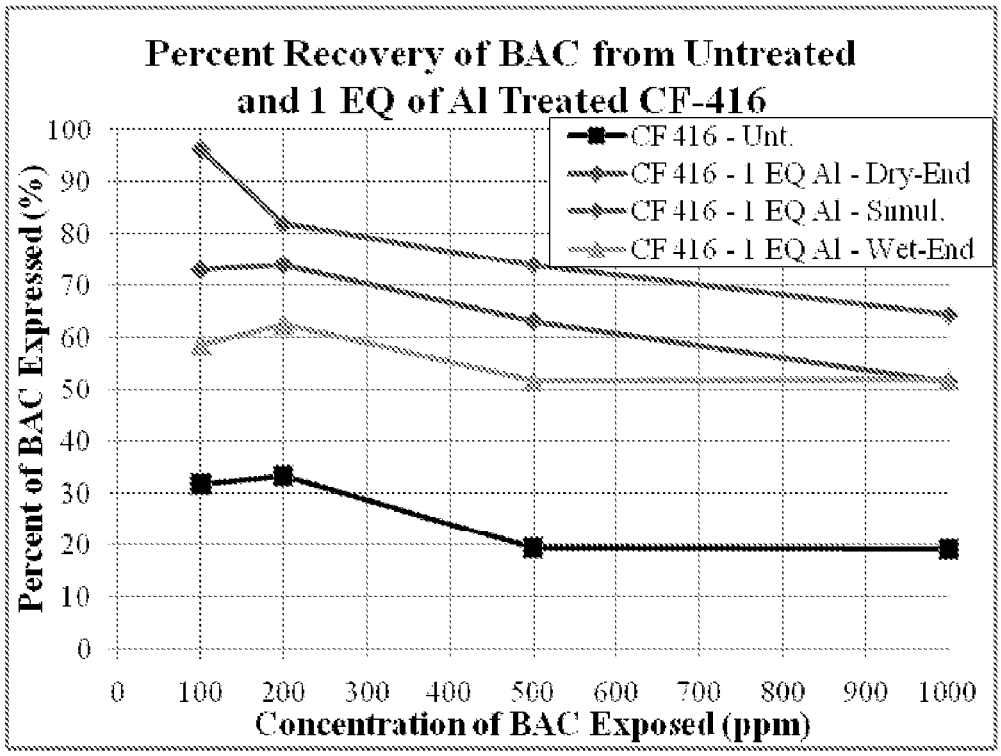

In the third series, the metal salt was added directly to the quaternary ammonium salt solutions (Al—Simult. in FIG. 4). The quaternary ammonium salt/metal salt combined solutions were added to untreated pulp pieces in syringes as described in Example 1. In all 3 sample series, 1 equivalent of charge of aluminum sulfate was used. The concentration of rejected quaternary ammonium salt was measured by potentiometric titration as described in ASTM D 5806-95.

FIG. 4 compares the percent BAC rejection levels for 3 series described above with a control without metal salt addition (Unt. in FIG. 4). These results demonstrate that all 3 methods of metal salt addition were effective in reducing the amount of quaternary ammonium salt that was adsorbed onto the pulp fibers.

EXAMPLE 3

Singulated Fiber vs. Sheet Form Comparison

In the preceding experiment the wood pulp fibers were in a wet-laid sheet form when they were exposed to the solutions containing quaternary ammonium salts. In this example, compositions in which the fibers were in sheet form were compared with compositions where the fibers were in singulated fluff form. The singulated fibers had a much greater absorbency for aqueous solutions, including the quaternary ammonium salt solution used, than the fibers in sheet form. Therefore, it was necessary to increase the liquid to fiber ratio in order assure all of the fibers would be wetted. A 6:1 liquid to fiber ratio was found to be adequate in wetting the singulated fiber samples.

In order to understand the effect of the liquid to fiber ratio separate from the effect of singulated fiber vs. sheet form, a comparison was done with pulp sheet samples at both 3:1 and 6:1 liquid to fiber ratios. The wood pulp fibers used for these experiments were CF405 and CF416. Both are bleached kraft southern pine pulps manufactured by Weyerhaeuser NR Co at Columbus Miss. CF405 contains a debonder to make the wet-laid pulp sheet softer and easier to defibrate, while CF416 does not contain a debonder. The aluminum sulfate solutions were applied to dry pulp sheets with a syringe, as described in Example 2. The aluminum sulfate treated pulp sheet samples were exposed to quaternary ammonium salt solutions as described in Example 1. The percentage of quaternary ammonium salts present in the expressed solution were measured by ASTM method D 5806-95 using potentiometric titration.

Figure 5:
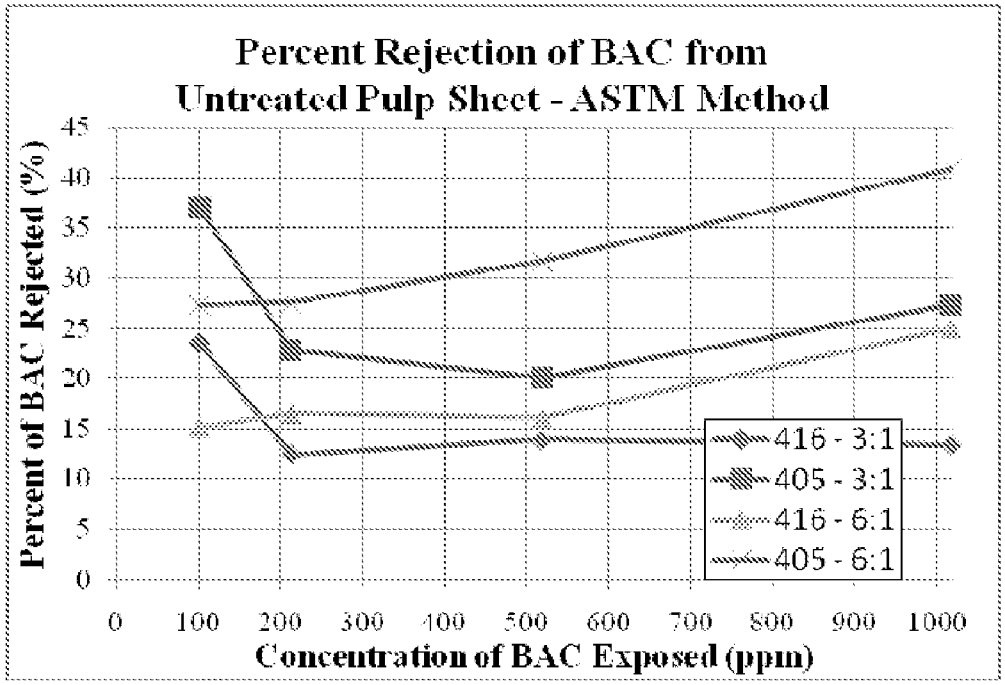

The results in FIG. 5 indicate that a higher percentage of the quaternary ammonium salts are rejected when the liquid to fiber level was increased from 3:1 to 6:1 due to an increased ratio of total quaternary ammonium salt molecules to carboxylic acid groups on the fiber. There is a spike in the rejection numbers at low concentrations of quaternary ammonium salt in the case of the 3:1 samples (and are likely related to insufficient wetting issues), but not in the case of the 6:1 samples.

Next, CF416 and CF405 pulp sheets were treated with 3 charge equivalents of aluminum sulfate with a syringe as described in Example 2. Part of the aluminum treated 405 and 416 materials were then fiberized in a Kamas laboratory hammermill to yield a singulated fiber fluff. Also untreated pulp sheets were similarly fiberized as controls. The untreated fluff, untreated pulp sheet, aluminum treated fluff, and the aluminum treated sheet samples were exposed to quaternary ammonium salt solutions as described in Example 1 except that a 6:1 liquid to fiber ratio was used for the fluff samples and half of the aluminum treated sheet samples. The other half of the aluminum treated sheet samples were exposed to 3:1 ratio of the quaternary ammonium salt solutions. The concentration of the rejected quaternary ammonium in the expressed solutions was measured by ASTM method D 5806-95.

Figure 6:
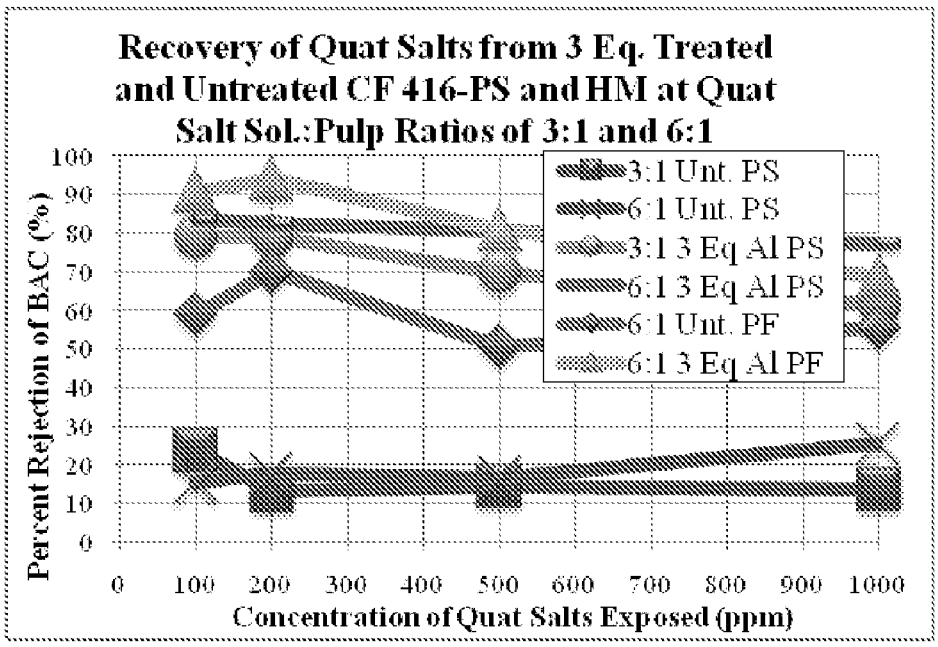
Figure 7:
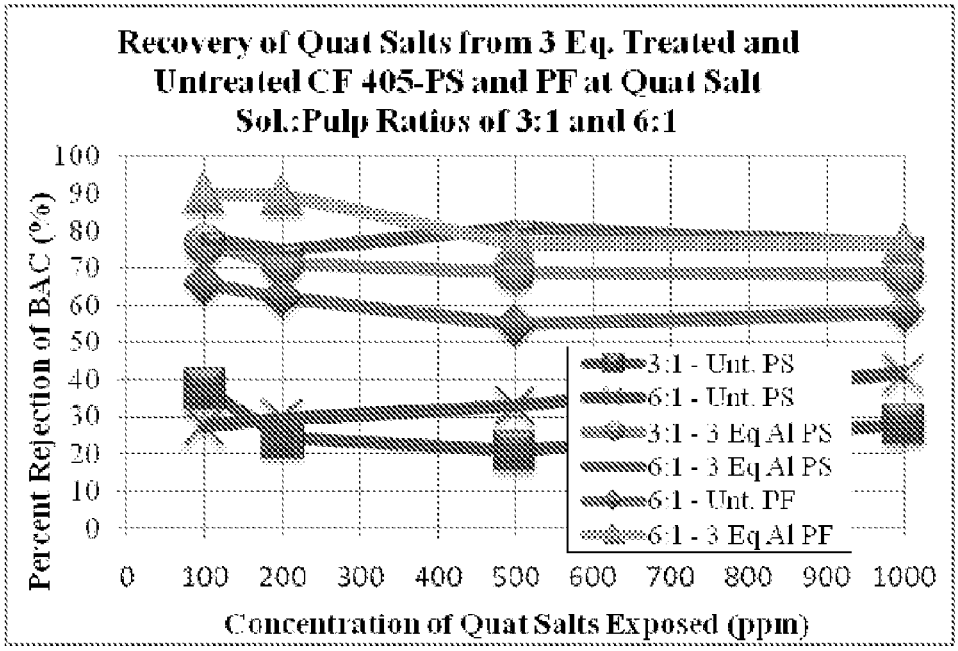

The results are summarized in FIGS. 6 and 7 for CF416 and CF405, respectively. In these figures, PS is used to designate the pulp sheet samples and PF the pulp fluff samples. Clearly, as shown before, the addition of aluminum sulfate significantly improved the percentage of BAC rejected by the pulp fibers.

These results also showed that the untreated fluff samples gave higher rejection levels than the untreated sheet samples. This was attributed to the difficulty in fully wetting the pulp fluff with the quaternary ammonium salt solution as well as the difficulty of flow through essentially a plug of pulp fluff that exists in the syringe during the experiment. This would hypothetically result in quaternary ammonium salt depleted regions, not due to interaction with carboxylic acid group in the pulp, but due to very slow diffusion these regions would not be equilibrated with portions of the solution that had not come into contact with the pulp carboxylic acid groups and were thus not depleted of quaternary ammonium salts.

EXAMPLE 4

Comparison of Results With Different Quaternary Ammonium Salt and Different Aluminum Salt Treatment Levels In this example, the percent quaternary ammonium salt rejection was tested using BAC, DDAC, and Virex. Virex is a commercially available antimicrobial solution made by Johnson Wax. According to the MSDS, it contains about a 1:1 mixture of BAC and DDAC, as well as other ingredients. Aluminum sulfate treated wood pulp samples were produced from NB416 and NF405, which are southern pine bleached kraft wood pulps manufactured by Weyerhaeuser NR in New Bern N.C. NF405 contains a debonder, whereas NB416 does not contain a debonder. A commercial solution of aluminum sulfate (26.8% (wt.) $Al_2(SO_4)_3$) was sprayed onto the pulp sheet as the sheet was being rewound from one spool to another. The amounts deposited upon the pulp sheet were calculated as being 3 and 5 charge equivalents of $Al^{3+}$. These amounts were calculated by knowing both the pump rate of aluminum sulfate solution at a certain RPM of the pump as well as the sheet velocity. This is a good candidate for how this invention would be implemented in an industrial setting.

Aluminum sulfate pulp sheet samples prepared in the above manner as well as untreated pulp sheet samples were exposed to quaternary ammonium salt solutions as described in Example 1. The concentration of rejected quaternary ammonium salts in the expressed solutions was measured by ASTM method D 5806-95. In this case, one series of experiments was performed with BAC, another was performed with DDAC and another was performed with Virex. The results are compared in FIGS. 8 and 9 for NB416 and NF405.

Figure 8:
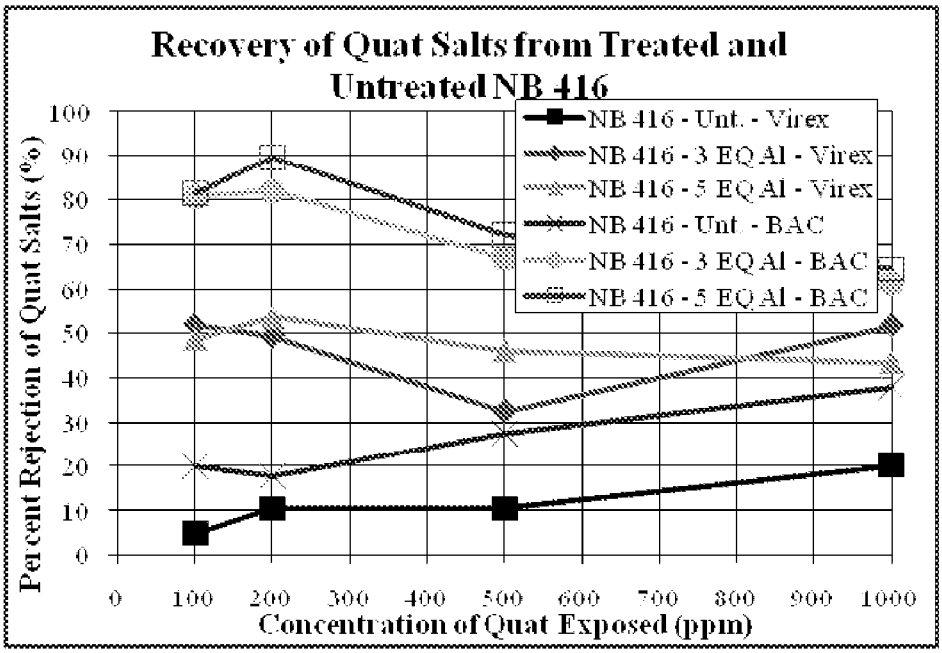

In FIG. 8, the rejection levels of Virex and BAC were compared for compositions containing a quaternary ammonium salt solution and either untreated NB416, or NB416 treated with either 3 or 5 charge equivalents of aluminum. The untreated NB416 compositions rejected about 18 to 38% of the BAC and 5 to 20% of the Virex. The aluminum sulfate treated NB416 compositions rejected 60-90% of the BAC and 32 to 55% of the Virex. The NB416 treated with 5 charge equivalents of aluminum sulfate provided slightly better performance than the samples treated with 3 charge equivalents.

Figure 9:
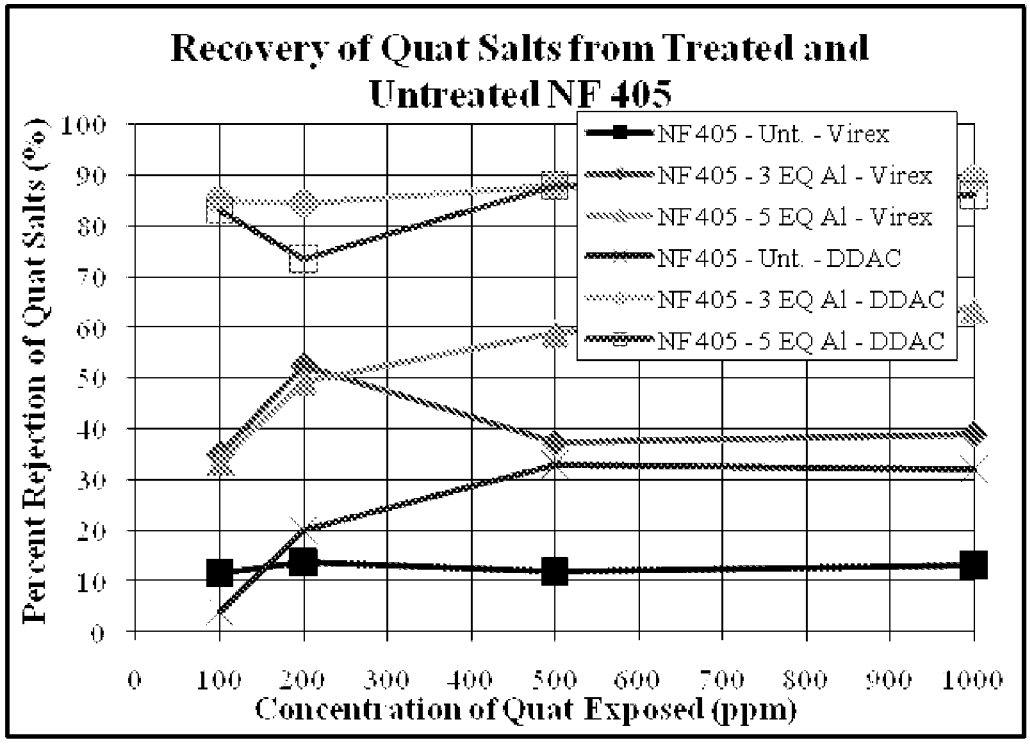

In FIG. 9, the rejection levels of Virex and DDAC were compared for composition containing a quaternary ammonium salt solution and either untreated NF405 or NF405 treated with either 3 or 5 charge equivalents of aluminum. The untreated NF405 compositions rejected about 5-33% of the DDAC and 10-14% of the Virex. The aluminum sulfate treated samples rejected about 75-90% of the DDAC and 30-65% of the Virex. Again the samples with the samples with 5 charge equivalents of aluminum tended to perform better than the samples with 3 charge equivalents of aluminum.

Overall, the results show that the compositions containing aluminum cations rejected quaternary ammonium salts much better than the compositions without aluminum cations. In both the circumstances with and without aluminum cations a higher proportion of the pure quaternary ammonium salts (BAC and DDAC) were rejected than observed with quaternary ammonium salts from Virex.

EXAMPLE 6

CE Test Method For Analyzing Quaternary ammonium Salts in Solution

1. Scope

This method is applicable to the determination of alkylbenzyldimethyl ammonium chlorides in reagent water and to aqueous client matrices after recovery confirmation via sample spiking. Alkyl groups ranging from n-$C_{12}H_{25}$ to n-$C_{16}H_{33}$ have been shown in the literature to be separated by this method. The present application is limited to n-$C_{12}H_{25}$ and n-$C_{14}H_{29}$ alkyl substituents as these are the ones present in BAC. It is based on the work of Ya-Hui, et al. adapted for the Agilent G1600A Capillary Electrophoresis System.

| Analyte | Range (μg/mL) |
|---|---|
| C12-BAC | 1.0-30 |
| C14-BAC | 1.0-30 |

2.0 Summary of Method

In capillary electrophoresis, solutes are separated in an electrolyte-filled fused silica capillary due to differences in their electrophoretic mobilities. Useful features of CE include: the ability to determine anions, cations, and neutral species using the various modes of separation, short analysis times, high efficiency separations, selective or universal detection modes (using a photodiode array detector), the ability to analysis complex matrices with little sample preparation, and the use of simple commercially-available buffers and inexpensive capillary columns. The Agilent CE system has an autosampler carousel which provides for unattended operation. Each analytical method provides a recommended technique for dilution, and occasionally, derivatization of the samples to be analyzed. Before the prepared sample is introduced into the CE, a procedure for standardization must be followed to determine the recovery and the limits of detection for the analytes of interest. Following sample introduction into the CE, analysis proceeds with a comparison of sample values with standard values. Qualitative identification is by means of migration time (MT) and quantitative analysis is achieved through integration of peak area which is normalized by migration time.

The present application uses a simple phosphate buffer modified with acetonitrile. This modification disrupts BAC micelle formation and adsorption of BAC to the capillary wall. For this method, the buffer is 40 mM sodium phosphate (pH 4.0) in 40% acetonitrile. At pH 4.0, the BAC is protonated and migrates toward the detector where they are detected by direct absorbance at 200 nm. Caution is warranted regarding BAC levels higher than 50 μg/mL. Preliminary work using higher concentrations fouled the capillary to the point of no migration being seen within a reasonable time. Replacing the capillary column was required.

3.0 Interferences 3.1 No interferences were noted. The samples are prepared at a dilution of at least 20 to 1, due to expected levels being higher than the calibrated range. The initial samples are likely to be sufficiently clean as to not present an interfering matrix.

3.2 Fresh buffer and column conditions typically provide a stable baseline near the analyte migration times. As the buffer is used over the course of a series of runs, spurious responses will be seen both early and late in the separation. As the baseline stabilizes and migration times don't shift, this is generally of little concern. Initial analyses indicate buffer stability for up to 13 runs. After buffer vial replacement, migration times become stable after an initial standard run.

3.3 Changes in migration times and resolution are symptoms of buffer deterioration or may be caused by the buildup of contaminants on the inner capillary wall. Refer to the manufacturer's guidelines for instructions on cleaning the column. If the above procedures do not restore the retention times, replace the column.

3.4 The presence of air bubbles or particulants in the column may cause baseline fluctuations, low current readings, or peak variability. All samples require filtration to 0.45 μm. Commercial buffer systems are already filtered. The use of degassed water for dilution may help to minimize the introduction of air. Freshly prepared buffer must be degassed ultrasonically during filtration.

4.0 Amount of Sample Required

A sample of 40 mL is preferred. The amount of diluted sample required depends on vial type used. It is recommended that glass vials be used. They require 500 μL. The actual criterion is the sample vials need to be filled to a level 1.4 cm from the base. This is a requirement of the CE injection system. Always using the same vial volume supports injection reproducibility. Samples have required two dilutions: a 1 to 25 dilution for BAC when it is known present; and a 1 to 5 dilution for a good detection limit for others. Hence, the actual minimum volume requirement has been determined by filtration needs and is likely to be on the order of 1 mL.

5.0 Sampling, Sample Handling, and Preservation

Samples have been stored in plastic bottles without apparent deleterious effect. The sample should be stored at 4° C. (39° F.) and returned to the lab for analysis as soon as possible. There is no known holding time for BAC solutions. Commercially available aqueous solutions are stable at a 50% concentration when refrigerated. Material Safety Data Sheets for various BAC mixtures also state these are stable compounds.

6.0 Equipment Required 6.1 Capillary Electrophoresis System

The Agilent G1600A Capillary Electrophoresis System contains in one cabinent an autosampling carosel, a thermostatted capillary column cassette, A Diode Array Detector (DAD) operating in the UV-Visible range, an integral high voltage power supply capable of both positive and negative inlet electrode voltages, and a buffer solution replenishment system (if needed). The ChemStation data acquisition and analysis system is supported by a PC running Windows XP Professional SP 2.

6.2 Capillary Column

The capillary column used for this application is the Agilent P/N G1600-61232. It is a bare fused silica capillary with a 50 μm internal diameter, a length of 56 cm, and an extended light path bubble cell. The bubble cell is an internal bubble blown into the detector region of the column. As it widens the inner channel, it produces an extended path for absorbance detection. An attribute of laminar flow in CE keeps the analyte zone from mixing in the larger volume and thus maintains the concentration within the zone.

6.3 Detector

The DAD is used with a signal wavelength of 200 nm and bandwith of 20 nm. The reference wavelength is 425 nm (50 nm). The detection method uses the direct scheme in which a UV absorbing analyte creates an absorbance signal. The reference wavelength helps compensate for minor shifts in the buffer background.

6.4 Data Acquisition System

The Agilent G1600A Capillary Electrophoresis System includes a version of ChemStation software configured for use with CE. In one PC environment are combined instrument control, raw data acquisition and reduction, and report generation. All aspects are included in a single method file.

6.5 Glassware/Plasticware

If one is preparing a CE buffer system from individual components, it is generally recommended to use polypropylene volumetric flasks dedicated to each aqueous buffer. This avoids trace contamination from the glass surface which could affect migration time stability and cleanliness of the electropherogram baseline. This method uses an operator-prepared buffer system.

6.5.19-mL borosilicate glass culture tube, VWR, 47729-572.

6.5.2 14-mL borosilicate glass culture tube, VWR, 47729-576.

6.5.3 Polyethylene Cap for 14-mL Tube, Becton Dickinson, Falcon 352030.

6.5.4 2-mL (3 mL) Norm-Ject disposable syringe with Luer adapter.

6.5.5 GHP Acrodisc 25 mm 0.45 micron syringe filter, 6.5.6 2-mL clear (glass) wide opening crimp vial, Agilent 5181-3375.

6.5.7 Snap caps, polyurethane for 2-mL vials, Agilent 5181-1512.

6.5.8 Microduster III, CleanTex, inert gas for glassware dust purging.

To avoid particulate contamination, it is a good idea to purge test tubes and vials with a quick burst of inert Microduster III gas just prior to use. Calibration standards and samples are prepared in disposable glass ware. The final dilutions of standards and samples are filtered using disposable filter cartridges and dispensed into disposable glass sample vials. Volumetric pipettes should be used to measure stock solutions. The pipettes may be either fixed or variable volume and preferably those with disposable tips in order to reduce contamination.

7.0 Reagents and Materials 7.1 Buffer System

The buffer is based on a 66.7 mM $NaH_2PO_4.H_20$ solution adjusted to pH 4.0 using phosphoric acid. It is then mixed with actonitrile to a final concentration of 40 mM.

7.1.1 Sodium Phosphate, Monobasic, monohydrate ($NaH_2PO_4.H_20$), 100.7%, JTBACer 3818-01/Lot Y10145. Formula weight is 137.99 g/mol.

7.1.2 Phosphoric acid, 85.2%, JT BACer 0260-05/Lot N08803. Formula weight is 98.0 g/mol.

7.1.3 Acetonitrile (ACN), B&J, Biosyn Grade, BB017-4 Lot CM370.

7.1.4 Distilled deionized water, use the distilled water available from SLM 212S-5. It has been demonstrated as clean for CE work. If used immediately as a water blank, it requires filtration.

To make a buffer stock solution place 1.058 gm $NaH_2PO_4.H_20$ in a 100 mL polypropylene volumetric flask and add ca. 90 mL of distilled deionized water. Swirl until dissolved, then carefully dispense into a 100 mL plastic beaker and add a small Teflon-coated stir bar. Use a pH meter calibrated for measurement between pH 4 and 7 to measure the initial pH. It should read about pH 4.3. Take a disposable glass pipet and just wet it with conc. phosphoric acid. A quick dip into the buffer should lower its pH significantly. Less than a drop of acid is required to adjust the pH to 4.0. Use dilute NaOH solution to raise the pH, if needed. Once adjusted, redispense the buffer into the 100 mL volumetric, fill to volume, shake well, then pour into a 4 oz. plastic bottle.

The run buffer is composed as 40:60 ACN:Phosphate. A convenient volume is composed by placing 2400 μL ACN into a 14 mL tube with 3600 μL pH 4.0 phosphate buffer, capping, then mixing well by inversion. This volume is immediately vacuum filtered through a 0.45 μm filter with ultrasonic degassing for about a minute. Significant degassing is seen initially. This filtered buffer is immediately dispensed into the glass CE sample vials as determined by the method run table. Currently, there is need for 4 buffer vials. Fill them to 1.0 ml and cap them with polyurethane caps.

7.2 Standard Solutions

The stock standard solution is best prepared as needed within the week of its use. The working standard is a dilution which is completely used to make the calibration standards. The calibration standards are prepared in sufficient volume for a single filtration and use. It may be best to consider these solutions as replaceable after one week. Store the solutions at 4° C. in freshly-capped CE sample vials.

7.2.1 Benzalkonium Chloride (BAC), 100%, Alpha Easar 41339 (current lot: E22R060). Label states a range only for alkylation, but analysis has demonstrated this is 60% dodecyl (C12) form and 40% is tetradecyl (C14) form. As this is a mixture, there is no single formula weight. The calibration is performed in units of μg/ml.

7.2.3 Distilled water, use the distilled water available from SLM 212S-5. It has been demonstrated as clean for CE work. If used immediately as a water blank, it requires filtration.

Methanol, B&J, Purge and Trap Grade, 232-1 (current lot: CN637).

7.2.4 70:30 Methanol:Water. A convenient volume is prepared by adding 3.0 mL of Distilled water to 7.0 mL P&T methanol. This is the CE sample diluent and further protects the BAC from micelle formation.

The BAC stock standard is prepared 70:30 methanol:water. Place 8.0 mg BAC in a 4 mL screw cap vial and add 4.0 ml using a pipet for a concentration of 2000 μg/mL. A working 500 μg/mL standard is prepared using 250 μl of this stock in 1000 mL total volume of 70:30 MeOH:$H_2O$. A final volume of 1 mL is likely stable to evaporation for the short period it is needed to make the calibration standards.

The six calibration standards currently defined in the method are then prepared using aliquots of the 500 μg/mL (or 10 μg/mL) working standard added to separate 9-mL borosilicate glass culture tubes for final dilution to 1000 or 3000 μL in 70:30 MeOH:$H_2O$ according to the following table.

| | Standard # | | | | | |
|---|---|---|---|---|---|---|
| | #1 | #2 | #3 | #4 | #5 | #6 |
| Final Conc, μg/mL | 1 | 5 | 10 | 15 | 20 | 30 |
| Final Volume, μL | 1000 | 1000 | 3000 | 1000 | 1000 | 1000 |
| Stock Conc, μg/mL | 10 | 10 | 500 | 500 | 500 | 500 |
| Volume Stock, μL | 100 | 500 | 60 | 30 | 40 | 60 |
| C12-BAC, μg/mL | 0.60 | 3.0 | 6.0 | 9.0 | 12 | 18 |
| C14-BAC, μg/mL | 0.40 | 2.0 | 4.0 | 6.0 | 8.0 | 12 |

After all additions have been made, the tube is briefly hand shaken or vortexed then the contents immediately drawn into 3-mL disposable syringe. A 0.45 μm filter is added and 0.5 mL filtered directly into the CE autosampler vial.

7.3 Sample Containers

Samples have been provided for analysis in polyethylene sample bottles with no apparent deleterious effects. The best CE operability has been found using the 2-mL glass vials sealed with the polyurethane snap caps. Proper sealing is essential as the system uses pressure for sample injection and monitors system pressure for failure.

While the preferred embodiment of the invention has been illustrated and described, it will be appreciated that various changes can be made therein without departing from the spirit and scope of the invention.

The invention claimed is:

1. A product comprising cellulosic wood pulp fiber in sheet form, 0.0001 to 0.03 moles of one or more water soluble aluminum salts per 100 grams of cellulosic fiber on the basis of oven-dried weight of cellulosic fiber, water in the amount of a 3:1 to 6:1 weight/weight ratio of water to cellulosic fiber and one or more quaternary ammonium salts, wherein 50% or more of the quaternary ammonium salts are in solution and not attached to the fibers to provide 100 to 3000 ppm of the quaternary ammonium salts in solution.

2. The product of claim 1 wherein the metal salts are present in an amount of 0.001 to 0.02 moles of aluminum salts used per 100 grams of cellulosic fiber, on the basis of oven-dried weight of the cellulosic fiber.

3. The product of claim 1 wherein the metal salts are present in the amount of 0.001 to 0.02 moles of each aluminum salt per 100 grams of cellulosic fiber, on the basis of oven-dried weight of cellulosic fiber.

4. The product of claim 1 wherein the quaternary ammonium salts are selected from n-alkyl benzyl dimethyl ammonium chlorides; di-n-alkyl dimethyl ammonium chlorides; and n-alkyl dimethyl ethylbenzyl ammonium chlorides.

5. The product of claim 1 wherein the cellulosic fibers are wood pulp fibers.

6. The product of claim 4 wherein the wood pulp fibers include a debonder, cationic polymer, clay, or a mixture thereof.

7. The product of claim 1 further comprising synthetic fibers.

8. The method of making a cellulosic product comprising combining cellulosic fiber, 0.0001 to 0.03 moles of one or more water soluble aluminum salts per 100 grams of cellulosic fiber on the basis of oven-dried weight of the cellulosic fiber, water in the amount of a 3:1 to 6:1 weight/weight ratio of water to cellulosic fiber and one or more quaternary ammonium salts, wherein 50% or more of the quaternary ammonium salts are in solution and not attached to the fibers to provide 100 to 3000 ppm of quaternary ammonium salts in solution.

9. The method of claim 8 wherein the cellulosic fiber and aluminum salts are combined prior to combining with quaternary ammonium salts.

10. The method of claim 8 wherein the cellulosic fiber, the aluminum salts and the quaternary ammonium salts are combined at the same time.

11. The method of claim 8 wherein the quaternary ammonium salts and aluminum salts are combined first and the mixture is combined with the cellulosic fiber.

12. The method of claim 8 wherein the cellulosic fiber is in the form of a sheet.

13. The method of claim 8 wherein the aluminum salts are present in an amount of 0.001 to 0.02 moles of each aluminum salt per 100 grams of cellulosic fiber, based on oven-dried weight of the cellulosic fiber.

14. The method of claim 8 wherein the quaternary ammonium salts are selected from n-alkyl benzyl dimethyl ammonium chlorides; di-n-alkyl dimethyl ammonium chlorides; and n-alkyl dimethyl ethylbenzyl ammonium chlorides.

15. The method of claim 8 wherein the cellulosic fibers are wood pulp fibers.

16. The method of claim 15 wherein the wood pulp fibers include a debonder, cationic polymer, clay or a mixture thereof.

* * * * *